US012723589B2

(12) United States Patent
Wahlgren

(10) Patent No.: US 12,723,589 B2
(45) Date of Patent: Sep. 1, 2026

(54) HIGH VISCOSITY PUMP AND ROTOR FOR PUMPING LIQUIDS, MATERIALS AND SLURRIES

(71) Applicant: Eddy Pump Corporation, El Cajon, CA (US)

(72) Inventor: Daniel Wahlgren, Escondido, CA (US)

(73) Assignee: Eddy Pump Corporation

( * ) Notice: Subject to any disclaimer, the term of this patent is extended or adjusted under 35 U.S.C. 154(b) by 0 days.

(21) Appl. No.: 19/333,526

(22) Filed: Sep. 19, 2025

(65) Prior Publication Data

US 2026/0085687 A1 Mar. 26, 2026

Related U.S. Application Data

(60) Provisional application No. 63/697,039, filed on Sep. 20, 2024.

(51) Int. Cl.

| | |
|---|---|
| ***F04D 7/04*** | (2006.01) |
| ***F04D 29/22*** | (2006.01) |
| ***F04D 29/42*** | (2006.01) |

(52) U.S. Cl.

CPC ..... *F04D 7/04* (2013.01); *F04D 29/22* (2013.01); *F04D 29/426* (2013.01)

(58) Field of Classification Search

CPC ..... F04D 5/001; F04D 17/161

See application file for complete search history.

(56) References Cited

U.S. PATENT DOCUMENTS

| | | | | |
|---|---|---|---|---|
| 4,940,385 | A | 7/1990 | Gurth | |
| 7,097,416 | B2 * | 8/2006 | Gurth | F04D 5/001 415/176 |
| 9,534,601 | B2 * | 1/2017 | Ree | F04D 1/06 |
| 11,680,578 | B1 * | 6/2023 | Jimenez | F04D 29/2216 416/223 B |
| 2007/0258824 | A1 | 11/2007 | Pacello et al. | |
| 2014/0086736 | A1 | 3/2014 | Ree | |

FOREIGN PATENT DOCUMENTS

| | | | |
|---|---|---|---|
| CN | 110439849 | A | 11/2019 |
| KR | 10-1873158 | B1 | 6/2018 |

OTHER PUBLICATIONS

International Search Report and Written Opinion corresponding to international application No. PCT/US2025/047077 dated Jan. 15, 2026.

* cited by examiner

*Primary Examiner* — Brian O Peters
(74) *Attorney, Agent, or Firm* — Spencer Fane, LLP

(57) ABSTRACT

An improved high viscosity pump system and its rotor are disclosed herein. In an embodiment, a high viscosity pump system includes a motor, a housing having an inlet and an adjacent rotor space, and a rotor. The rotor is located within the rotor space of the housing and is configured to be driven by the motor around a rotational axis. The rotor includes a first plate and a second plate that rotate together around the rotational axis to pump liquid, material or slurry from the inlet to discharge or an outlet.

20 Claims, 7 Drawing Sheets

HIGH VISCOSITY PUMP AND ROTOR FOR PUMPING LIQUIDS, MATERIALS AND SLURRIES

PRIORITY CLAIM

This application claims priority to U.S. Provisional Ser. No. 63/697,039, filed Sep. 20, 2024, entitled "Improved High Viscosity Pump and Rotor for Pumping Liquids, Materials and Slurries," the entire contents of which is incorporated herein by reference and relied upon.

BACKGROUND

Technical Field

The present disclosure generally relates to an improved high viscosity pump for liquids, materials and slurries. The present disclosure also generally relates to an improved rotor design for pumping liquids, materials and slurries.

Background Information

Conventional pumps are designed to pump a variety of liquids, materials and slurries (i.e., solids suspended in liquid). One type of conventional pump is a centrifugal pump. With a centrifugal pump, liquid or slurry enters axially through a casing, is caught up in the impeller blades, and is tangentially and radially spun outward through a diffuser part of the casing. When pumping slurries, it is important to minimize direct contact of solid material to the impeller, due to wear on the impeller.

SUMMARY

The present disclosure provides an improved rotor design, and an improved high viscosity pump utilizing the rotor design, with significant advantages over conventional pumps and rotors. For example, the pump and rotor design disclosed herein enables high viscosity pumping of liquids, materials and slurries without clogging, allows for larger particles to transfer to the pump discharge, creates a spiral column of energy traveling down through the intake to facilitate the slurry being pulled up into the pump in a counter-rotating manner, and improves intake to be more effective at pulling liquids, materials and slurries through turbid hydrodynamics rather than normal laminar intake flow associated with standard disc pumps. The rotor disclosed herein can also be made thicker or thinner to satisfy different application head requirements, and to provide rotor geometries to match (high head/low flow) or (low head/high flow) application requirements for maximum efficiency.

One aspect of the present disclosure is to provide an improved high viscosity pump system for pumping a liquid, material or slurry. The pump system includes a motor, a housing having an inlet and an adjacent rotor space, and a rotor. The rotor is located within the rotor space of the housing and is configured to be driven by the motor around a rotational axis. The rotor includes a first plate and a second plate that rotate together around the rotational axis to pump liquid, material or slurry from the inlet to discharge or an outlet.

A second aspect of the present disclosure is to provide a rotor for pumping a liquid, material or slurry. The rotor includes a first plate and a second plate. The first plate includes a first inner plate surface and a plurality of first blades projecting from the first inner plate surface. The second plate includes a second inner plate surface and a plurality of second blades projecting from the second inner plate surface. The first plate and the second plate have a fixed connection provided by at least one connecting element extending from the first inner plate surface to the second inner plate surface. The fixed connection causes the first plate and the second plate to be separated by a gap and to rotate together around a rotational axis.

A third aspect of the present disclosure is to provide another rotor for pumping a liquid, material or slurry. The rotor includes a first plate and a second plate. The first plate is configured to rotate around a rotational axis and has a solid surface intersecting the rotational axis. The second plate is fixed to the first plate so as to be separated from the first plate by a gap. The second plate is configured to rotate around the rotational axis together with the first plate and includes a plate aperture at the rotational axis.

Other objects, features, aspects and advantages of the devices and methods disclosed herein will become apparent to those skilled in the art from the following detailed description, which, taken in conjunction with the annexed drawings, discloses exemplary embodiments of the disclosed systems and methods.

BRIEF DESCRIPTION OF THE DRAWINGS

Referring now to the attached drawings which form a part of this original disclosure.

DETAILED DESCRIPTION

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Figure 1:
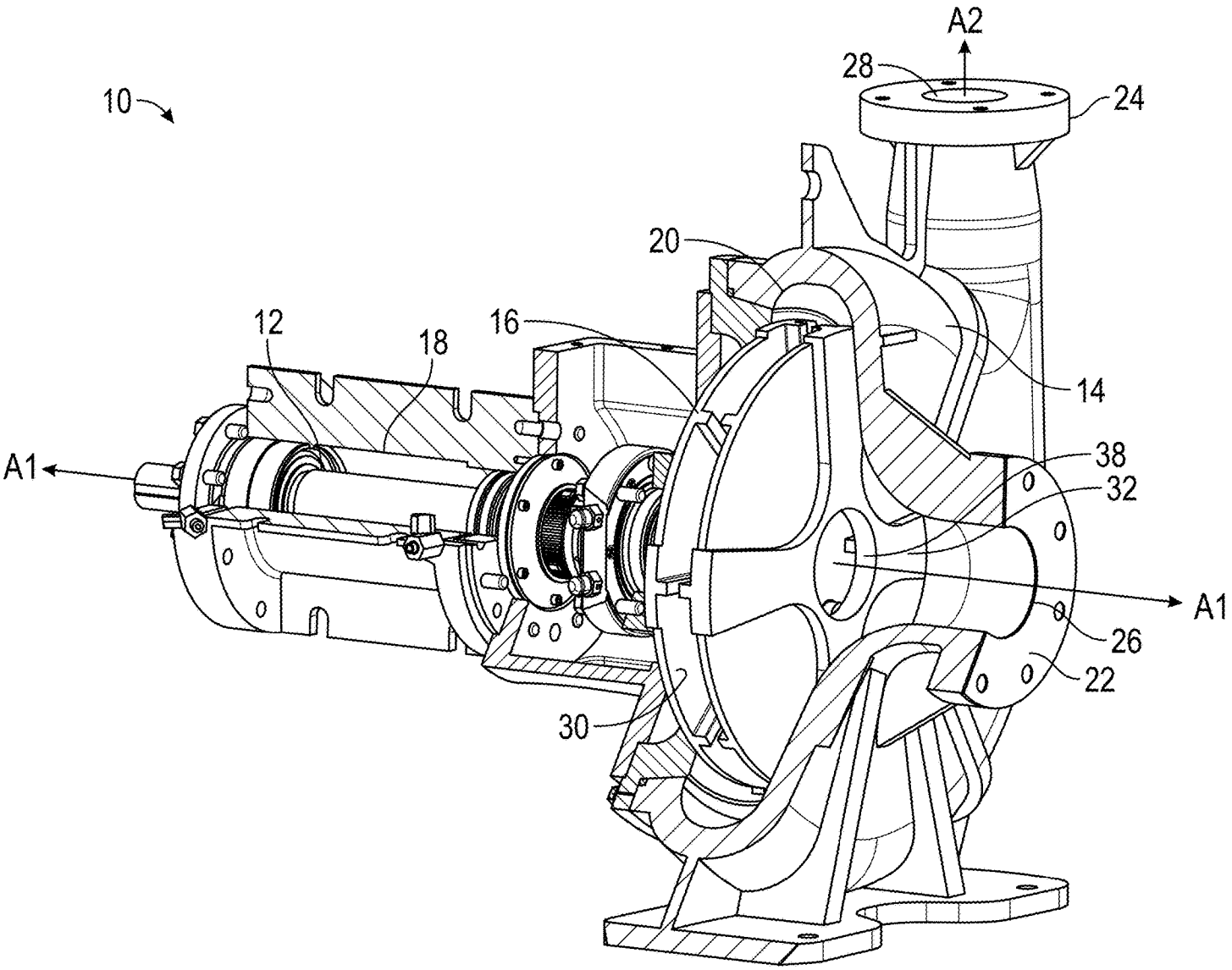
FIG. 1 illustrates a perspective view of an example embodiment of a high viscosity pump system in accordance with the present disclosure.
Figure 2:
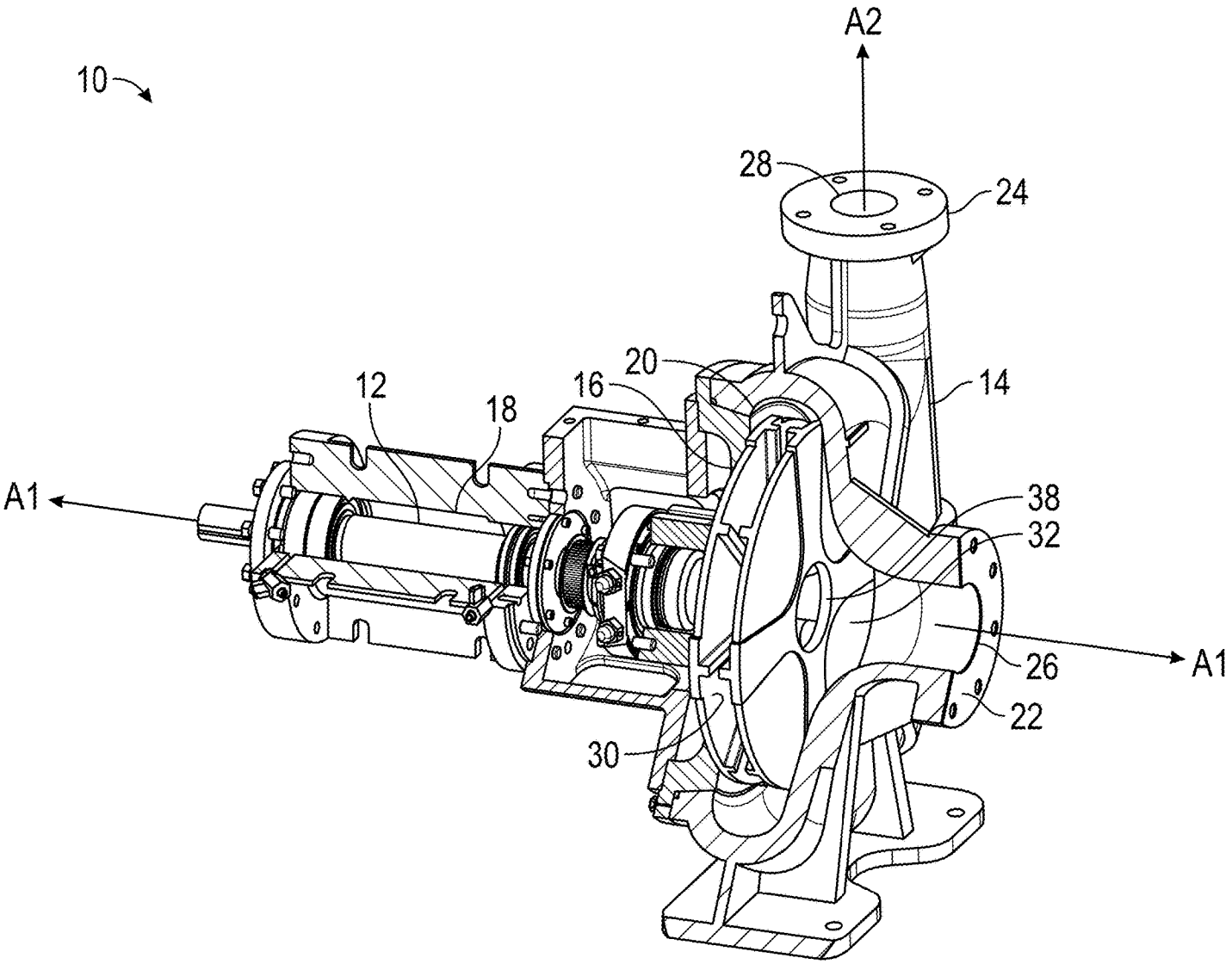
FIG. 2 illustrates another perspective view of the high viscosity pump system embodiment shown in FIG. 1.

FIGS. 1 and 2 illustrate an example embodiment of a high viscosity pump system 10 for pumping liquids, materials and slurries in accordance with the present disclosure. In the illustrated embodiment, the high viscosity pump system 10 includes a motor or motor arm (motor 12), a housing 14 and a pump rotor 16. The pump rotor 16 is located within the housing 14 such that liquids, materials and slurries can enter the housing 14 and be pumped through the housing 14 by the pump rotor 16. The pump rotor 16 is operatively connected to the motor 12 by a shaft (e.g., motor arm), and the motor 12 is configured to drive or rotate the pump rotor 16 to cause the pump rotor 16 to pump the fluid, liquids, materials and slurries from an inlet 22 to discharge. The motor 12 can be any suitable motor known in the art that is capable of driving the pump rotor 16 at suitable rotational velocities.

In the illustrated embodiment, housing 14 includes a motor space 18, a rotor space 20, an inlet 22, and a discharge or outlet 24. The motor space 18 is generally cylindrical has a length and diameter large enough to receive at least part of the motor or motor arm 12 and enable the motor or motor arm 12 to rotate therein around the rotational axis A1. The rotor space 20 is also generally cylindrical and has a length and diameter large enough to receive the rotor 16 and enable the rotor 16 to rotate therein around the rotational axis A1. The inlet 22 is generally cylindrical and includes an inlet aperture 26. The outlet 24 is generally cylindrical and includes an outlet aperture 28. In use, the motor 12 drives the rotor 16 to cause liquid, material or slurry to be pulled into the housing 14 through the inlet 22 and discharged from the housing 14 though the outlet 24. As seen in FIGS. 1 and 2, the motor space 18 is longer than the rotor space 20 in the axial direction of the rotational axis A1, while the rotor space 20 is has a larger diameter than each of the motor space 18 and the inlet 22 in the radial direction of the rotational axis A1. The outlet 22 is centered around a longitudinal axis A2 and extends further outward in the direction of the longitudinal axis A2 than the rest of the housing 14 and its components.

In the illustrated embodiment, the pump rotor 16 rotates around the rotational axis A1. The motor 12 also rotates around the rotational axis A1 to drive the pump rotor 16. As seen in FIGS. 1 and 2, the motor space 18, the rotor space 20 and the inlet 22 are all generally cylindrical with their center axes aligned with the rotational axis A1. The outlet 24 is offset from the rotational axis A1 on the rear side of the housing 12. The longitudinal axis A2 of the outlet 24 is generally offset 90 degrees with respect to the rotational axis A1 and generally tangential to the outer circumference of the pump rotor 16. The inlet 24 being located along the rotational axis A1 of the pump rotor 16 enables liquids, materials or slurry to be sucked or drawn into the inlet 22 based on rotation of the pump rotor 16. More specifically, the relative positioning and geometry of the pump rotor 16 and the inlet 20 creates a spiral column of energy traveling down through the inlet 22 to facilitate slurry being pulled up into the pump rotor 16 in a counter-rotating manner, and improves intake to be more effective at pulling liquids, materials and slurries through turbid hydrodynamics rather than normal laminar intake flow associated with standard disc pumps. The outlet 24 is disposed 90 degrees offset from the inlet 22 to enable the liquids, materials or slurry to be pumped out of the housing 14 via the outlet 24 as the pump rotor 16 rotates.

Figure 5:
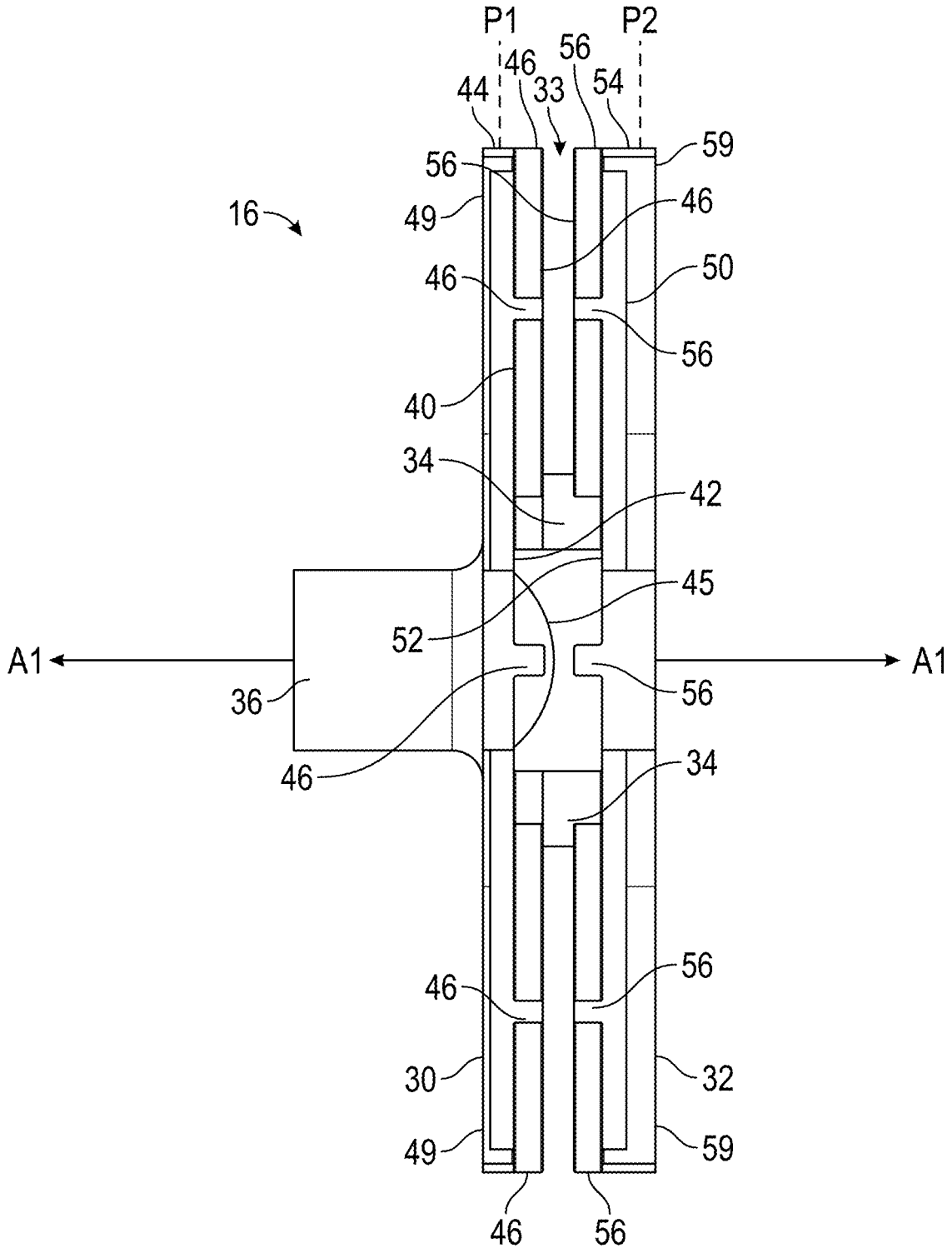
FIG. 5 illustrates a side elevational view of the pump rotor embodiment shown in FIG. 3.

FIGS. 3 to 7 illustrate an example embodiment of the pump rotor 16 in more detail. In the illustrated embodiment, the pump rotor 16 includes a first plate 30 and a second plate 32 separated by a gap or space 33 (gap 33) in the axial direction of the rotational axis A1. The first plate 30 and the second plate 32 are each generally round plates having the same general diameter and thickness. The first plate 30 and the second plate 32 are parallel and fixed together so that they rotate together around the rotational axis A1 to pump liquid, material or slurry from the inlet 22 towards discharge or the outlet 24. That is, as seen in FIG. 5, the first plate 30 is located in a first plane P1, the second plate 32 is located in a second plane P2, and the first plane P1 is parallel to the second plane P2. The diameters and thicknesses of the first plate 30 and the second plate 32 can vary depending on application requirements.

In the illustrated embodiment, the pump rotor 16 includes at least one connecting element 34 which extends from the first plate 30 to the second plate 32 to fix the first plate 30 to the second plate 32. More specifically, as seen in FIG. 5, the pump rotor 16 includes at least two connecting elements 34 which extend across the gap 33 from the first plate 30 to the second plate 32 to fix the first plate 30 to the second plate 32. The two connecting elements 34 are located on opposite sides of the rotational axis A1. The connecting elements 34 can be projections that extend from the first plate 30 towards the second plate 32, or projections that extend from the second plate 32 towards the first plate 30. In an embodiment, the first plate 30 and the second plate 32 are bolted together via the connecting elements 34. For example, the first plate 30 can be bolted to connecting elements 34 formed on the second plate 32, or the second plate 32 can be bolted to connecting elements formed on the first plate 30. A connecting element 34 can also be a separate part that is placed between the first plate 30 and the second plate 32 that enables the first plate 30 and the second plate 32 to be attached together. The first plate 30 and the second plate 32 are fixed together via the connecting elements 34 to cause the first plate 30 and the second plate 32 to rotate together around the rotational axis A1 at the same speed when driven by the motor 12. Since the first plate 30 and the second plate 32 are turning from the same shaft, bolting them together as shown allows for optimal viscosity pumping.

Figure 3:
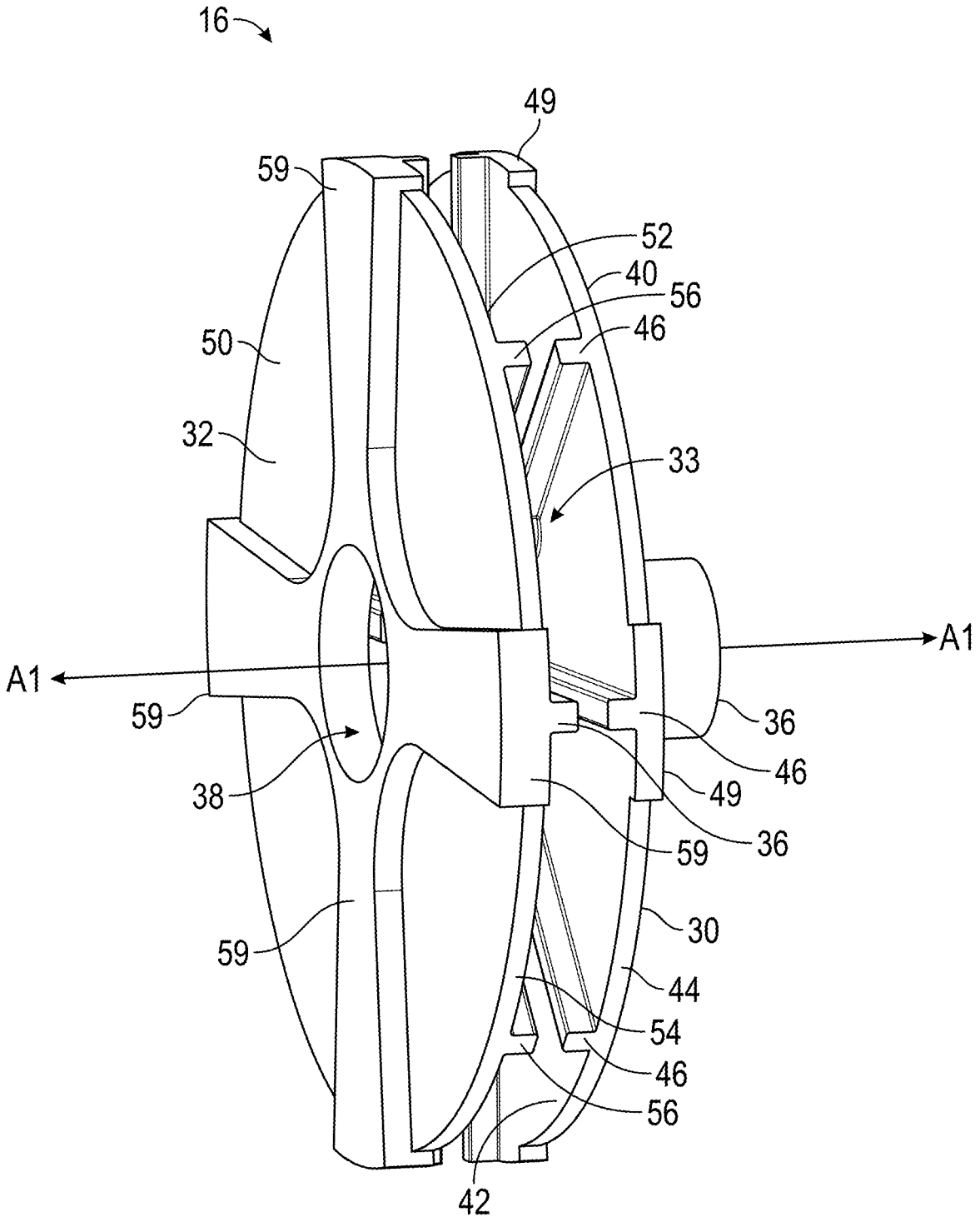
FIG. 3 illustrates a perspective view of an example embodiment of a pump rotor in accordance with the present disclosure.
Figure 4:
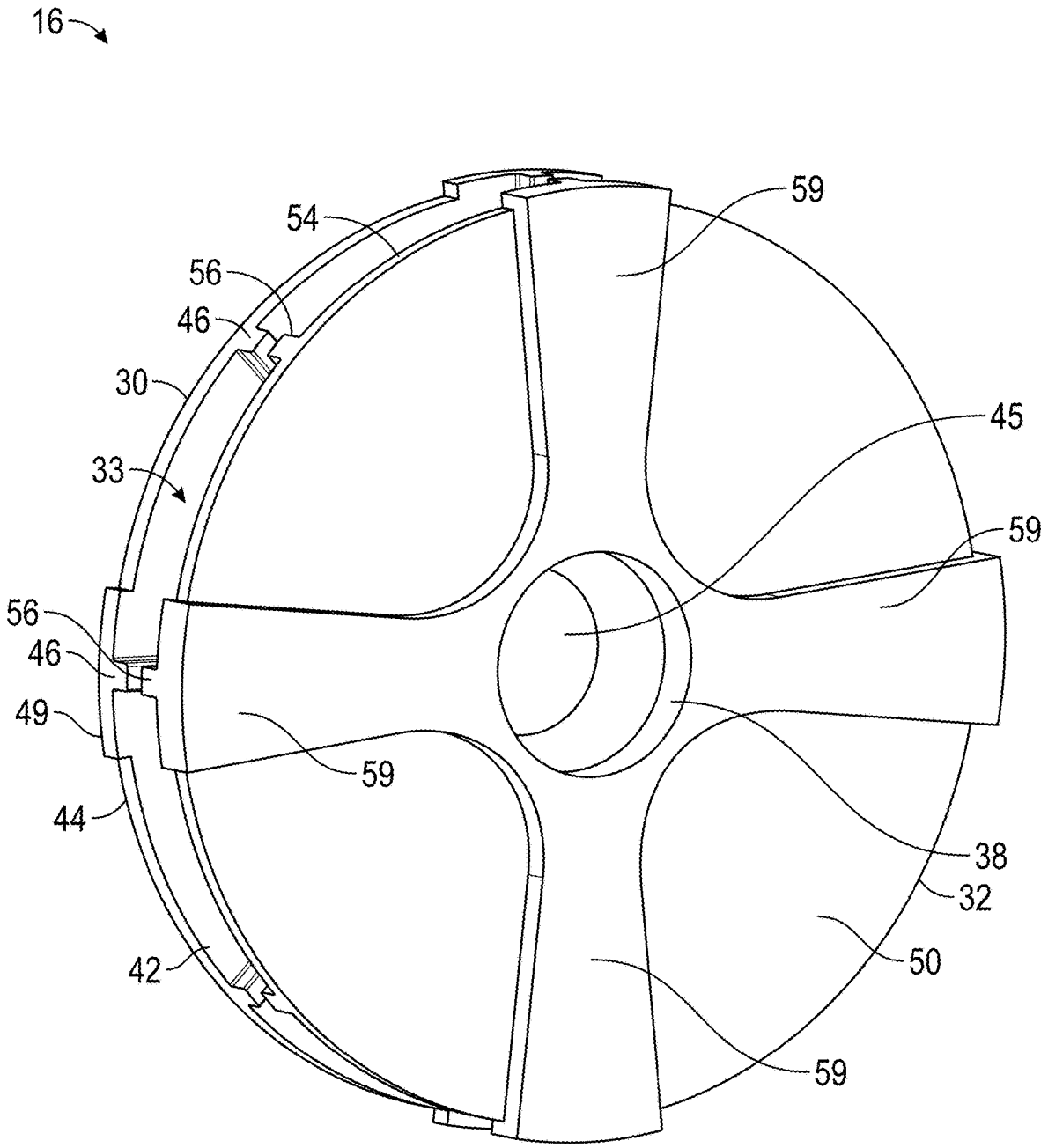
FIG. 4 illustrates another perspective view of the pump rotor embodiment shown FIG. 3.

As seen in FIGS. 3 and 5, the pump rotor 16 includes a motor arm coupling 36 at the center thereof. More specifically, the first plate 30 includes the motor arm coupling 36. The motor arm coupling 36 enables operative attachment of the pump rotor 16 to the motor 12, as seen for example in FIGS. 1 and 2. As further seen in FIG. 5, the motor arm coupling 36 extends outward from the center of the first plate 30 towards the motor 12 in the axial direction of the rotational axis A1. The motor arm coupling 36 can be integrally formed with the larger diameter portion of the first plate 30, or the motor arm coupling 36 can be a separate piece attached at the center of the larger diameter portion of the first plate 30. The motor 12 can be attached to the motor arm coupling 36 in various ways, for example, by bolting or other attachment mechanisms at the motor or motor arm 12 and/or motor arm coupling 36.

The second plate 32 includes a plate aperture 38 in the center thereof, which is aligned with the inlet 22, as seen for example in FIGS. 1 and 2. The plate aperture 38 encircles the rotational axis A1. The plate aperture 38 receives the liquid, material or slurry when the pump rotor 16 pumps the liquid, material or slurry from the inlet 22 towards discharge or the outlet 24. More specifically, when the pump rotor 16 rotates, large particles are pulled through the plate aperture 38, into the gap 33 between the planes of the first plate 30 and the second plate 32, and then the large particles are transferred to discharge or the outlet 24 by the rotational force of the pump rotor 16. In an embodiment, the plate aperture 38 has a diameter that is between 1/10 and 1/4 of the outer diameter of the first plate 30 and the second plate 32. In the illustrated embodiment, the one or more connecting elements 34 fixing the first plate 30 to the second plate 32 are located adjacent the outer edge of the plate aperture 38 on opposite sides of the rotational axis A1.

The first plate 30 has at least two plate surfaces 40, 42. In the illustrated embodiment, the first plate 30 includes an outer plate surface 40 and an inner plate surface 42. The first plate 30 also includes a circumferential surface 44 forming a width between the outer plate surface 40 and the inner plate surface 42. The outer plate surface 40 faces the motor 12 when the motor 12 is operatively connected to the rotor 16, while the inner plate surface 42 faces the second plate 32. In an embodiment, the outer plate surface 40 can be integrally formed with the motor arm coupling 36, so that the motor arm coupling 36 extends outwardly from the outer plate surface 40 at the rotational axis A1 for connection to the motor 12. In another embodiment, the motor arm coupling 36 can be a separate piece attached to the outer plate surface 40.

Figure 6:
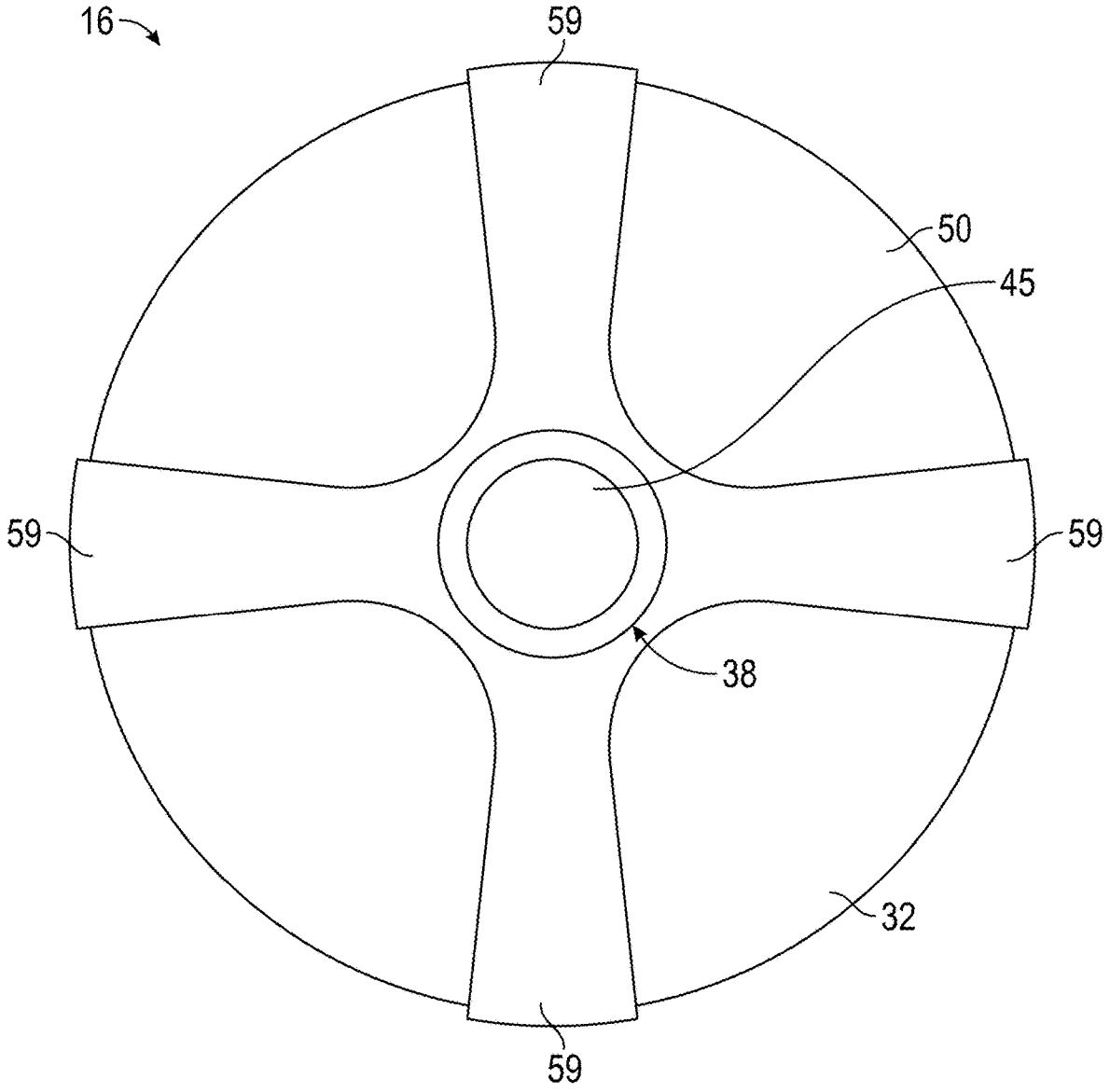
FIG. 6 illustrates a front elevational view of the pump rotor embodiment shown in FIG. 3.
Figure 7:
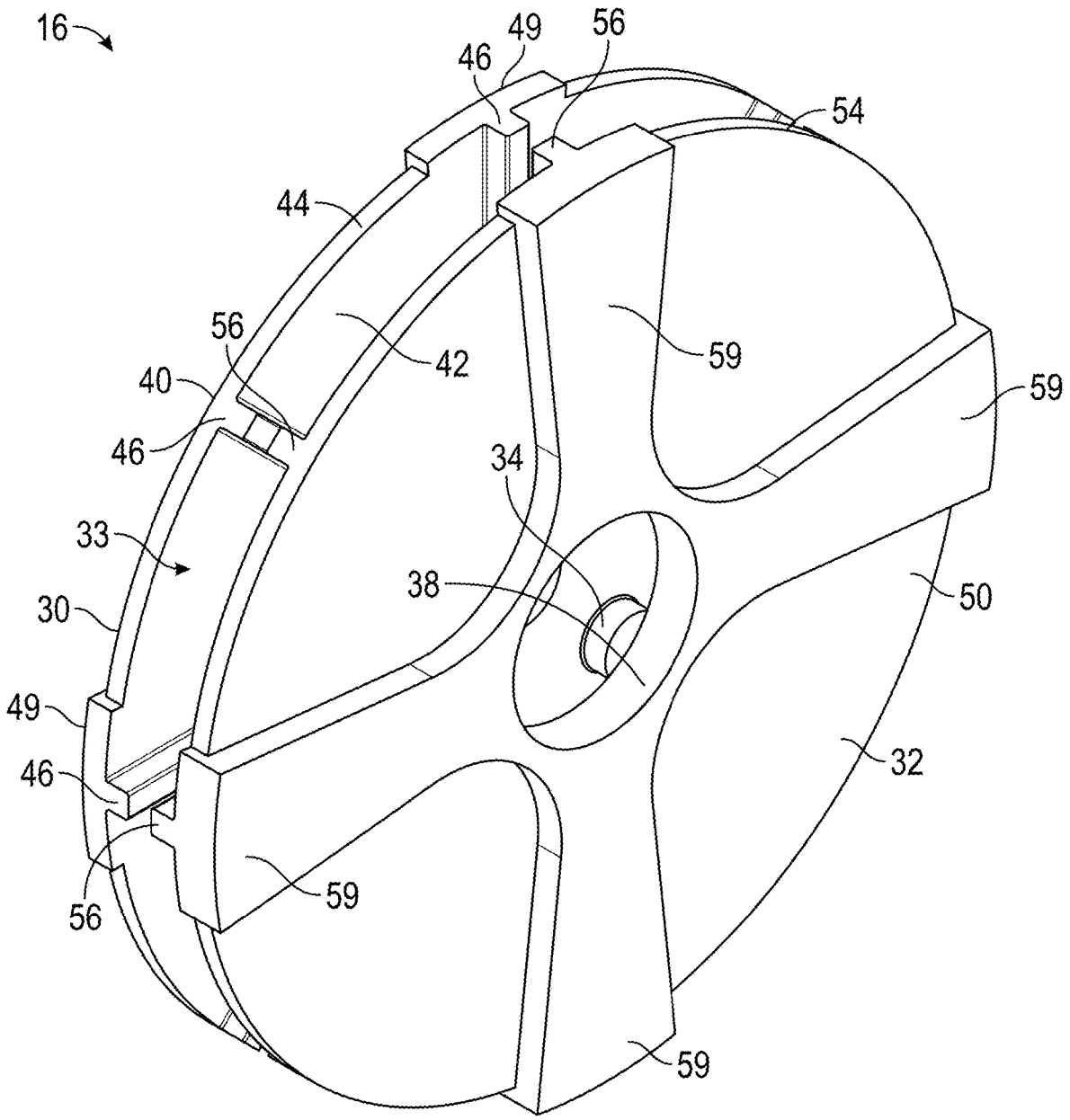
FIG. 7 illustrates another perspective view of the pump rotor embodiment shown in FIG. 3.

As seen in FIGS. 5 and 6, the pump rotor 16 includes an inner protrusion 45 which projects inwardly from the inner plate surface 42 into the gap 33. More specifically, the first plate 30 includes the inner protrusion 45. The inner protrusion 45 provides a solid surface intersecting the rotational axis A1. The inner protrusion 45 has a rounded and/or conical shape and projects inwardly into the gap 33 around the rotational axis A1, extending furthest into the gap 33 at the intersection point with the rotational axis A1. When liquid, material or slurry is pumped through the plate aperture 38 into the gap 33 between the first plate 30 and the second plate 32 during use of the pump rotor 16, the liquid, material or slurry can strike the inner protrusion 45 and disperse across the rounded and/or conical surface. The tapered shape of the inner protrusion 45 provides a smooth transition for the liquid, material and slurry being pumped to enter between the first blades 46 and second blades 56 of the pump rotor 16 as discussed below. Liquid, material and slurry that enter into the gap 33 of the pump rotor 16 are typically moving more slowly, and the inner protrusion 45 divides the inflow to the first blades 46 and second blades 56. In an embodiment, the inner protrusion 45 is formed by the inner plate surface 42. In another embodiment, the motor arm coupling 36 is formed as a separate part from the inner plate surface 42 and is attached so as to extend through the inner plate surface 42 with the inner protrusion 45 extending into the gap 33. That is, the inner protrusion 45 can be the inner end of the motor arm coupling 36 which extends into the gap 33 upon attachment to another component of the first plate 30. In another embodiment, the inner protrusion 45 is formed as a separate piece and attached to the inner plate surface 42. Alternatively, the inner protrusion 45 can be omitted and the first inner plate surface 42 can provide the solid surface as a flat surface at the rotational axis A1.

The first plate 30 includes a plurality of first blades 46 projecting from the inner plate surface 42 towards the second plate 32 and into the gap 33. The first blades 46 each extend radially from a central area at or near the inner protrusion 45 and/or the rotational axis A1 to a position at or near the edge of the circumferential surface 44. In the illustrated embodiment, the first plate 30 includes eight evenly spaced first blades 46, although those of ordinary skill in the art will recognize from this disclosure that more or less first blades 46 can be used. In the illustrated embodiment, the first blades 46 have a rectangular cross-section, although those of ordinary skill in the art will recognize from this disclosure that the first blades 46 can have other shapes. In the illustrated embodiment, the first blades 46 extend from the inner plate surface 42 a constant distance between the inner and outer edges thereof, but the first blades 46 can also taper inwardly or outwardly in the radial direction of the rotational axis A1.

In an embodiment, the first plate 30 includes at least one first thickened portion 49 with a thickness between the outer plate surface 40 and the inner plate surface 42 that is thicker than other portions of the first plate 30. The first thickened portions 49 can extend radially from a central area at or near the rotational axis A1 to a position at or near the edge of the circumferential surface 44. The first thickened portions 49 can align with one or more first blades 46 in a direction of the rotational axis A1. In the illustrated embodiment, the first plate 30 has four thickened portions 49, such that four first blades 46 align with a respective thickened portion 49 and four first blades 46 do not align with a respective thickened portion 49. In the illustrated embodiment, the thickened portions 49 are wider on the outer plate surface 40 than the width of the rectangular cross-section of the first blades 48 at the outer circumferential surface 44.

The second plate 32 has at least two plate surfaces 50, 52. In the illustrated embodiment, the second plate 32 includes an outer plate surface 50 and an inner plate surface 52. The second plate 32 also includes a circumferential surface 54 forming a width between the outer plate surface 50 and the inner plate surface 52. The outer plate surface 40 faces the inlet 22 when the rotor 16 is placed within the housing 14, while the inner plate surface 52 faces the inner plate surface 42 of the first plate 30. The plate aperture 38 extends through the outer plate surface 50 and the inner plate surface 52 at the rotational axis A1 and is centered around the rotational axis A1.

The second plate 32 includes a plurality of second blades 56 projecting from the inner plate surface 52 towards the inner plate surface 42 of the first plate 30 and into the space or gap 33. Like the first blades 46, the second blades 56 each extend radially from a central area at or near the rotational axis A1 to a position at or near the edge of the circumferential surface 54. More specifically, the second blades 56 each extend from the plate aperture 38 to the circumferential surface 44 the radial direction of the rotational axis A1. In the illustrated embodiment, the second plate 32 includes eight second blades 56, although those of ordinary skill in the art will recognize from this disclosure that more or less second blades 56 can be used. In the illustrated embodiment, the second blades 56 have a rectangular cross-section, although those of ordinary skill in the art will recognize from this disclosure that the second blades 56 can have other shapes. In the illustrated embodiment, the second blades 56 extend from the inner plate surface 52 a constant distance between the inner and outer edges thereof, but the second blades 56 can also taper inwardly or outwardly in the radial direction of the rotational axis A1.

In an embodiment, the second plate 32 includes at least one second thickened portion 59 with a thickness between the outer plate surface 50 and the inner plate surface 52 that is thicker than other portions of the second plate 32. The thickened portions 59 can extend radially from a central area at or near the rotational axis A1 of the second plate 32 to a position at or near the edge of the circumferential surface 54. More specifically, the second thickened portions 59 each extend from the plate aperture 38 to the circumferential surface 54 in the radial direction of the rotational axis A1. The second thickened portions 59 can align with one or more second blades 46 in a direction of the rotational axis A1. In the illustrated embodiment, the second plate 32 has four thickened portions 59, such that four second blades 56 align with a respective thickened portion 59 and four second blades 56 do not align with a respective thickened portion 59. In the illustrated embodiment, the second thickened portions 59 are wider on the outer surface 50 than the width of the rectangular cross-section of the second blades 56 at the outer circumferential surface 54. As seen in FIG. 5, in the illustrated embodiment, the second thickened portions 59 are thicker than the first thickened portions 49 in the direction of the rotational axis A1.

In the illustrated embodiment, the first plate 30 has a same number of first blades 46 as the second plate surface 32 has second blades 56. In the illustrated embodiment, each of the first blades 46 is aligned with a second blade 56 in the direction of the rotational axis A1. In the illustrated embodiment, the distance between the outer plate surface 40 and the inner plate surface 42 of the first plate 30 is approximately the same as the distance between the outer plate surface 50 and the inner plate surface 52 of the second plate 32.

As seen in FIG. 5, the first blades 46 extend from the inner plate surface 42 of the first plate 30 the same approximate distance that the second blades 46 extend from the inner plate surface 52 of the second plate 32. The gap 33 between the first blades 42 and the second blades 52 is also the same approximate distance as the extension of the first blades 46 and the second blades 56. Thus, in an embodiment, the first blades 42 extend from the inner plate surface 42 approximately ⅓ of the total distance between the inner plate surface 42 and the inner plate surface 52, the second blades 52 extend from the inner plate surface 52 approximately ⅓ of the total distance between the inner plate surface 42 and the inner plate surface 52, and the gap 33 between each corresponding first blade 42 and second blade 52 is approximately ⅓ of the total distance between the inner plate surface 42 and the inner plate surface 52. In an embodiment, the first blades 42 extend from the inner plate surface 42 approximately ¼ to ½ of the total distance between the inner plate surface 42 and the outer plate surface 52, the second blades 52 extend from the inner plate surface 52 approximately ¼ to ½ of the total distance between the inner plate surface 42 and the inner plate surface 52, and the gap 33 between each corresponding first blade 42 and second blade 52 is approximately ¼ to ½ of the total distance between the inner plate surface 42 and the outer plate surface 52.

In the illustrated embodiment, the first plate 30 has a same number of first thickened portions 49 as the second plate surface 32 has second thickened portions 59. In the illustrated embodiment, each of the first thickened portions 49 is aligned with a second thickened portion 59 in the direction of the rotational axis A1. In an embodiment, at least one of the first plate 30 and the second plate 32 includes a plurality of thickened portions 49, 59.

As seen in FIGS. 3 to 7, the inner plate surface 42 of the first plate 30 faces the inner plate surface 52 of the second plate 32, with the gap 33 located between the inner plate surface 42 and the inner plate surface 52 so as to receive the liquid, material or slurry via the plate aperture 38 when pumping from the inlet 22 to discharge or the outlet 24. The first blades 46 and second blades 56 extend into the gap to facilitate pumping to discharge or the outlet 24. In an embodiment, at least one of the first plate 30 and the second plate 32 includes a plurality of blades 46, 56 that project towards the other of the first plate 30 and the second plate 32.

As seen in FIGS. 1 and 2, the inlet aperture 26 of the inlet 22 is aligned with the plate aperture 38 of the second plate 32 along the rotational axis A1 to facilitate transfer of the liquid, material or slurry through the inlet aperture 26 and through the plate aperture 38 by creating a spiral column of energy from the inlet 22 into the pump rotor 16 in a counter-rotating manner. In the illustrated embodiment, the inlet aperture 26 of the inlet 22 has approximately the same diameter as the plate aperture 38. The outlet aperture 28 of the outlet 24 is located along the longitudinal axis A2 perpendicular to the rotational axis A1 to facilitate transfer of the liquid, material or slurry from the gap 33 between the inner plate surface 42 of the first plate 30 and the inner plate surface 52 of the second plate 32 towards the outlet aperture 28.

In an embodiment, the pump rotor 16 is fabricated from metal as either a cast, molded, forged or machined rotor. The material can include, for example, alloyed metal, steel, stainless steel, aluminum, zinc, bronze, or metal, other material of plastics, rubbers, or hybrid materials. The material preferably will not rust or corrode in water, salt water or corrosive fluid environment. The pump rotor 16 can be formed as a single piece or as multiple attached pieces.

The embodiments described herein provide an improved rotor design for pumping liquid, material and slurry, and an improved pump utilizing the rotor design. These designs are advantageous, for example, because they enable high viscosity pumping of large particles without clogging and improve intake to be more effective at pulling liquid, material and slurry using turbid hydrodynamics. It should be understood that various changes and modifications to the systems and methods described herein will be apparent to those skilled in the art and can be made without diminishing the intended advantages.

General Interpretation of Terms

In understanding the scope of the present invention, the term "comprising" and its derivatives, as used herein, are intended to be open ended terms that specify the presence of the stated features, elements, components, groups, and/or steps, but do not exclude the presence of other unstated features, elements, components, groups, integers and/or steps. The foregoing also applies to words having similar meanings such as the terms, "including", "having" and their derivatives. Also, the terms "part," "section," or "element" when used in the singular can have the dual meaning of a single part or a plurality of parts.

The term "configured" as used herein to describe a component, section or part of a device includes hardware constructed to carry out the desired function.

The terms of degree such as "substantially", "about" and "approximately" as used herein mean a reasonable amount of deviation of the modified term such that the end result is not significantly changed.

The terms "first" and "second" as used herein are to distinguish like parts, points, locations, etc. and can be reordered or used interchangeably. The terms "first" and "second" are not intended to be limiting.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such features. Thus, the foregoing descriptions of the embodiments according to the present invention are provided for illustration only, and not for the purpose of limiting the invention as defined by the appended claims and their equivalents.

What is claimed is:

1. A high viscosity pump system comprising:

a motor;

a housing having an inlet and an adjacent rotor space; and a rotor located within the rotor space of the housing and configured to be driven by the motor around a rotational axis, the rotor including a first plate and a second plate that rotate together around the rotational axis to pump liquid, material or slurry from the inlet to discharge or an outlet, the first plate including a first inner plate surface, a first outer plate surface, a first circumferential surface, a plurality of first blades projecting from the first inner plate surface, and a plurality of first thickened portions projecting from the first outer plate surface and being wider than the first blades at the first circumferential surface, and the second plate including a second inner plate surface, a second outer plate surface, a second circumferential surface, a plurality of second blades projecting from the second inner plate surface, and a plurality of second thickened portions projecting from the second outer plate surface and being wider than the second blades at the second circumferential surface.

2. The high viscosity pump system of claim 1, wherein the first plate has a solid surface intersecting the rotational axis, and the second plate has a plate aperture at the rotational axis.

3. The high viscosity pump system of claim 2, wherein the inlet includes an inlet aperture aligned with the plate aperture along the rotational axis.

4. The high viscosity pump system of claim 2, wherein the rotor includes an inner protrusion which provides the solid surface intersecting the rotational axis.

5. The high viscosity pump system of claim 1, wherein the plurality of first blades are aligned with the plurality of second blades in an axial direction of the rotational axis.

6. The high viscosity pump system of claim 1, wherein the housing includes an outlet having a longitudinal axis tangential to an outer circumference of the rotor.

7. The high viscosity pump system of claim 1, wherein the plurality of first blades project from the first inner plate surface towards the second plate, and the plurality of second blades project from the second inner plate surface towards the first plate.

8. A rotor for a pump system, the rotor comprising:

a first plate including a first inner plate surface, a first outer plate surface, a first circumferential surface, a plurality of first blades projecting from the first inner plate surface, and a plurality of first thickened portions projecting from the first outer plate surface and being wider than the first blades at the first circumferential surface; and a second plate including a second inner plate surface, a second outer plate surface, a second circumferential surface, a plurality of second blades projecting from the second inner plate surface, and a plurality of second thickened portions projecting from the second outer plate surface and being wider than the second blades at the second circumferential surface, the first plate and the second plate having a fixed connection provided by at least one connecting element extending from the first inner plate surface to the second inner plate surface, the fixed connection causing the first plate and the second plate to be separated by a gap and to rotate together around a rotational axis.

9. The rotor of claim 8, wherein the first plate has a same number of first blades as the second plate has second blades.

10. The rotor of claim 9, wherein each of the first blades is aligned with a second blade in an axial direction of the rotational axis.

11. The rotor of claim 8, wherein the first plate has a solid surface intersecting the rotational axis, and the second plate has a plate aperture at the rotational axis.

12. The rotor of claim 8, wherein the first blades extend along the first inner plate surface in a radial direction of the rotational axis, and the second blades extend along the second inner plate surface in the radial direction of the rotational axis.

13. A rotor for a pump system, the rotor comprising:

a first plate configured to rotate around a rotational axis and having a solid surface intersecting the rotational axis, the first plate including a first inner plate surface, a first outer plate surface, a first circumferential surface, a plurality of first blades projecting from the first inner plate surface, and a plurality of first thickened portions projecting from the first outer plate surface and being wider than the first blades at the first circumferential surface; and a second plate fixed to the first plate so as to be separated from the first plate by a gap, the second plate configured to rotate around the rotational axis together with the first plate, the second plate including a plate aperture at the rotational axis, a second inner plate surface, a second outer plate surface, a second circumferential surface, a plurality of second blades projecting from the second inner plate surface, and a plurality of second thickened portions projecting from the second outer plate surface and being wider than the second blades at the second circumferential surface.

14. The rotor of claim 13, wherein the second plate has an outer diameter, and the plate aperture has a diameter that is between 1/10 and 1/4 of the outer diameter.

15. The rotor of claim 13, wherein the first plate includes an inner protrusion extending from the first inner plate surface into the gap, the inner protrusion providing the solid surface intersecting the rotational axis.

16. The rotor of claim 13, wherein the first plate and the second plate are fixed together by at least one connecting element extending across the gap from the first inner plate surface to the second inner plate surface.

17. The rotor of claim 13, wherein the plurality of first blades project from the first inner plate surface towards the second plate; and the plurality of second blades project from the second inner plate surface towards the first plate.

18. The rotor of claim 13, wherein the first inner plate surface provides the solid surface intersecting the rotational axis.

19. The rotor of claim 13, wherein the first plate includes a motor arm coupling extending through the inner plate surface and providing the solid surface intersecting the rotational axis.

20. The rotor of claim 8, wherein the plurality of first thickened portions further project radially outwardly from the first circumferential surface of the first plate, and the plurality of second thickened portions further project radially outwardly from the second circumferential surface of the second plate.

* * * * *